United States Patent [19]

Yoshida

[11] Patent Number: 4,587,742

[45] Date of Patent: May 13, 1986

[54] SCALE BALANCING DEVICE IN UNIVERSAL PARALLEL RULER DEVICE

[75] Inventor: Yasutomo Yoshida, Tokyo, Japan

[73] Assignee: Mutoh Industry Ltd., Tokyo, Japan

[21] Appl. No.: 689,897

[22] Filed: Jan. 9, 1985

[51] Int. Cl.[4] ..... B43L 13/02

[52] U.S. Cl. ..... 33/438; 33/440

[58] Field of Search ..... 33/438, 440, 439, 448, 33/430

[56] References Cited

U.S. PATENT DOCUMENTS 4,070,758 1/1978 Watanabe ..... 33/438

*Primary Examiner*—Willis Little

*Attorney, Agent, or Firm*—Wenderoth, Lind & Ponack

[57] ABSTRACT

A scale balancing device for balancing the weight of the scales of a universal parallel ruler, the device having a head structure having the scales rotatably mounted thereon, a rotating member rotatably mounted on the head structure separate from the scales, the rotating member and the rotatable scales being rotatably interlocked, and a spring having one end rotatably connected to a point on the rotating member eccentric to the axis of rotation thereof and the other end rotatably connected to a non-rotatable part of the head structure, the spring, when the scales are rotated to a position vertically in line with the axis of rotation thereof, having substantially no tension therein and when the scales are rotated ninety degrees from such position, having tension for exerting a maximum force on the eccentric connection point on the rotating member and sufficient in magnitude and having a direction which substantially cancels out the torque on the rotating member from the weight of the scales.

5 Claims, 21 Drawing Figures

SCALE BALANCING DEVICE IN UNIVERSAL PARALLEL RULER DEVICE

BRIEF SUMMARY OF THE INVENTION

This invention relates to a scale balancing device in universal parallel ruler device wherein a scale is caused to be set in a freely rotatable condition relative to a non-rotating member of a head on an inclinable drawing board whereby the scale is not rapidly rotated in a downward direction due to an inclination of the drawing board to maintain the scale in a stable and static condition.

Scale balancing devices in a universal parallel ruler device are available in various types, but the devices are classified roughly into a balance weight system and an eccentric cam system. The balance weight system is one in which the weight of a balance weight is caused to work in a direction opposite to the rotating direction on a member interlocked with the rotation of a scale in a downward direction to balance the scale by the action of the weight. A balancing device of this type is disclosed in the publications, for example, the Japanese Utility Model Publication No. 47-9748, Japanese Patent Publication No. 57-47040, Japanese Patent Publication No. 57-49399 and Japanese Patent Publication No. 58-4640. On the other hand, eccentric cam system is one in which a spring is caused to work on an eccentric cam interlocked with the rotation of a scale, and a rotatory torque is generated on the eccentric cam by the elastic force of the spring in a direction opposite to the rotating direction of the scale due to the weight of the scale to balance the scale. A balancing device of the eccentric cam system type is disclosed in the Japanese Utility Model Publication No. 52-28605.

The balancing weight system has a drawback, for example, that the weight becomes heavy due to the use of the balance weight and also the manual rotation of the scale by the inertia force of the balance weight becomes difficult. The eccentric cam system has a drawback that, for example, frictional force is generated on the elastic contact portion of the spring and the eccentric cam whereby the manual rotation of the scale by the frictional force becomes difficult.

A primary object of this invention is to provide a scale balancing device which does not use a balance weight and an eccentric cam, and the scale is maintained in a balanced condition by connecting a spring member to a rotating member that rotates by interlocking with the scale, whereby the scale can be rotated by a light manual operation.

Another object of this invention is to maintain a complete balance of a scale and to prevent the scale from rapid rotation in a downward direction weight of the scale when a head is static on an inclined V due to the drawing board and the scale is set in a free rotating condition. In order to achieve the foregoing object, this invention is constructed in such a way that one end of spring means is rotatably supported on a non-rotating means of a head, and the other end of the spring means is rotatably connected to an eccentric portion of the rotating member that rotates with the rotation of a scale, and a rotatory torque is generated by the elastic force of the spring means on the rotating member in a direction opposite to the rotating direction due to the weight of the scale, and the setting is made so that the elastic force of the spring means, namely, flexibility becomes zero, when the portion of the spring means connected with the rotating member is shifted to a rotation support portion of the spring means on the non-rotating member, and the rotatory torque of the rotating member due to the weight of the scale and the rotatory torque of the rotating member supplied by the spring means are completely balanced.

DESCRIPTION OF THE PREFERRED EMBODIMENT

A construction of this invention will be described in the following by referring to the attached drawings.

Figure 1:
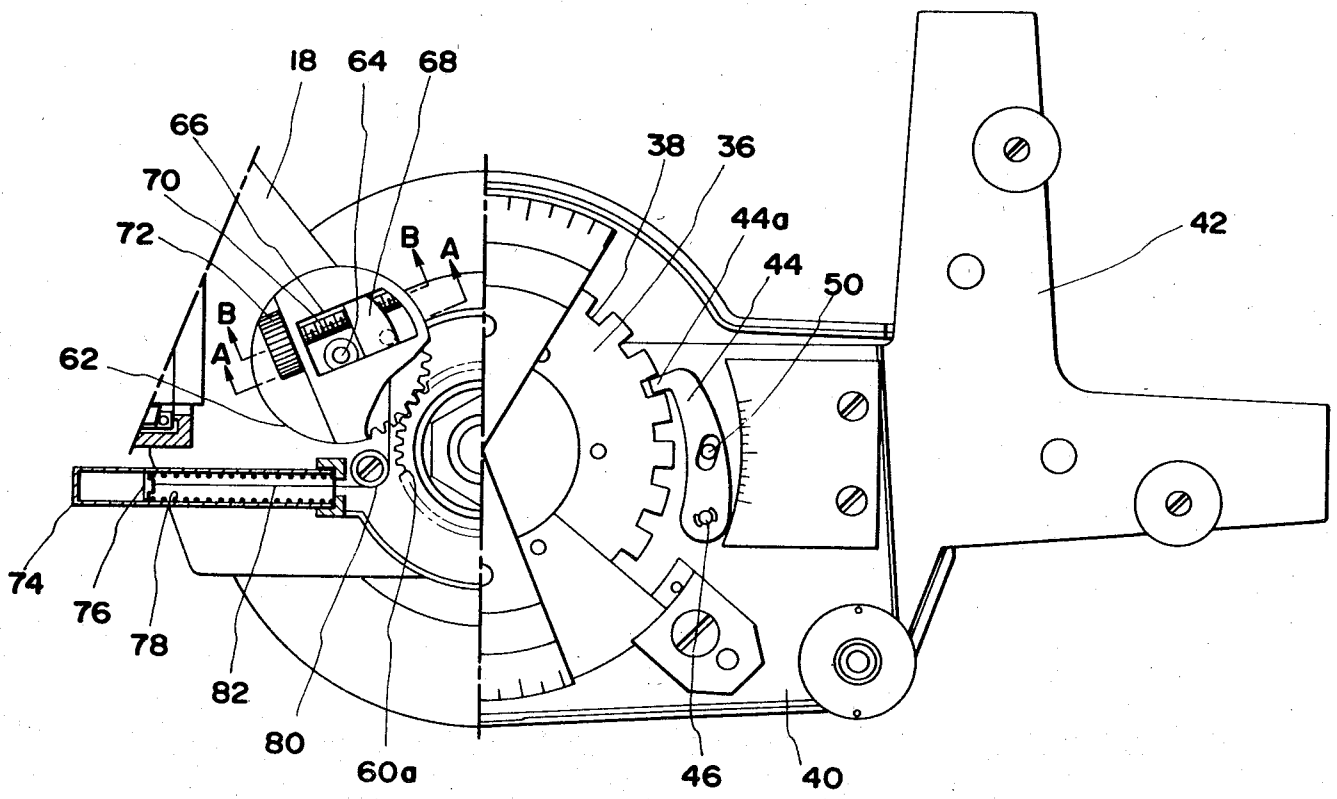
FIG. 1 is a plan of a head partly cut away and with the cover of the head removed.
Figure 2:
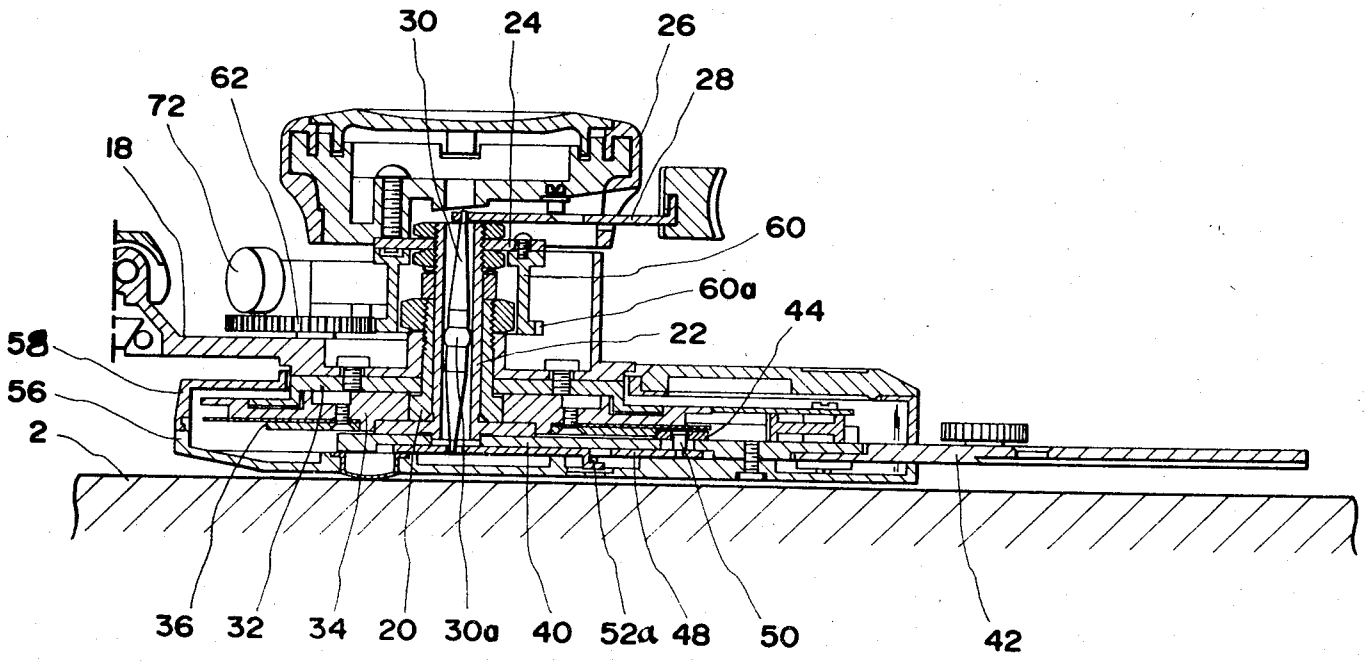
FIG. 2 is a cross section of the head.
Figure 3:
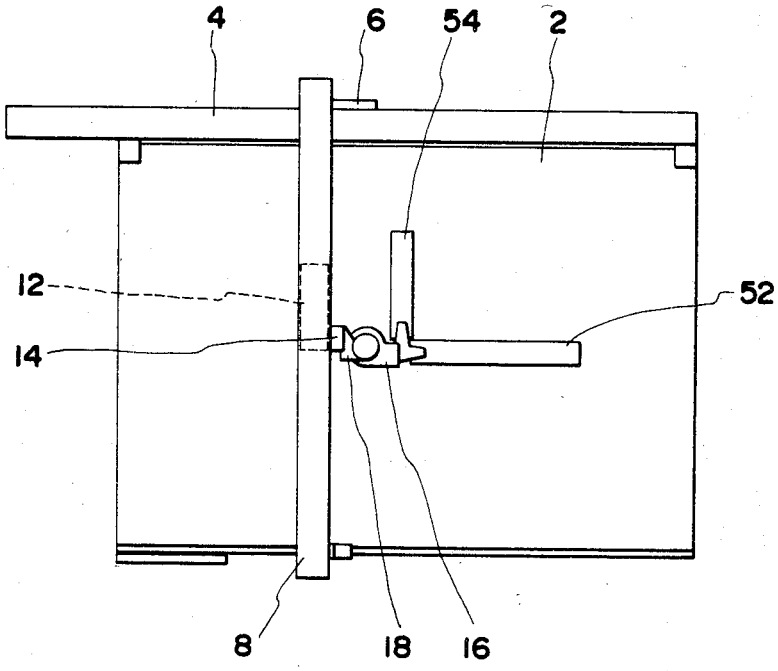
FIG. 3 is the elevation of an entire rail type universal parallel ruler device.
Figure 4:
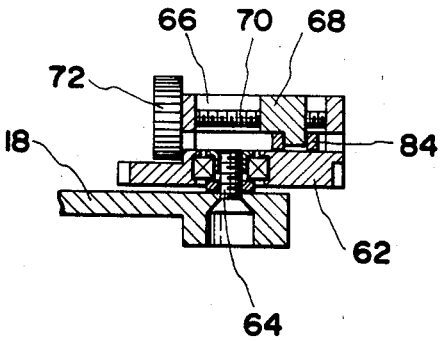
FIG. 4 is a cross section taken on line A—A in FIG. 1.
Figure 5:
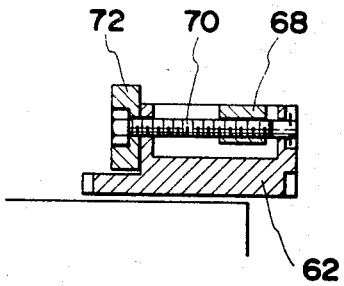
FIG. 5 is a cross section taken on line B—B in FIG. 1.

In FIG. 3, numeral 2 denotes a drawing board, which is supported on a support frame of a stand of a drawing board tiltable to and fixable at a desired angle. Numeral 4 denotes a horizontal rail disposed on the upper side of the drawing board 2, and a horizontal cursor 6 is shiftably mounted on the horizontal rail 4. The upper end of a vertical rail 8 is connected to the horizontal cursor 6. The lower end of the vertical rail 8 is shiftably mounted on the drawing board 2 by means of a tail portion roller (not shown). Numeral 12 denotes a vertical cursor mounted shiftably on the vertical rail 8, and a support base plate 18 of a head 16, which is a non-rotating member, is connected to the vertical cursor 12 by means of a known double hinge mechanism 14. As shown in FIG. 2, a tube 20 is fixed to a tubular portion of the support base plate 18 by means of a nut. Numeral 22 denotes a spindle tube, and its outer peripheral surface is inserted rotatably into the tube 20 in engagement with the inner peripheral surface thereof, and a mounting plate 24 is fixed to an upper portion of the spindle tube 22 by means of a nut. A grip handle 26 is fixed to the mounting plate 24. Numeral 28 denotes an index lever, and its one end portion is coupled to the upper end of a conical bar 30 disposed in the interior of the spindle tube 22. Numeral 32 denotes a stationary disc fixed to the support base plate 18, and 34 denotes a protractor rotatably fitted on the outer peripheral surface of the flange portion of the tube 20, and the protractor 34 is fixed to the stationary disc 32 by means of a stationary mechanism (not shown) capable of being released. Numeral 36 denotes an index ring fixed to the protractor 34, and concave index recesses (refer to FIG. 1) are formed on its outer peripheral surface predetermined intervals. Numeral 40 denotes a base plate fixed to the flange portion of the spindle tube 22, and a scale mounting plate 42 is mounted on the base plate 40. Numeral 44 denotes a swing arm rotatably supported on the base plate 40 by means of a shaft 46, and its pawl portion 44*a* is fitted to one of the concave index portions 38. One end of the transmitting member 48 is connected to the lower end of the conical bar 30, and a shaft 50 fixed to the other end of the transmitting member 48 is fitted to the long groove in the swing arm 44. The transmitting member 48 is urged in a leftward direction in FIG. 2 by a spring member 52*a*. The index lever 28, conical bar 30, index ring 36, swing arm 44 and transmitting member 48 constitute means for fixing the base plate to the protractor 34 and releasing the base plate 40 therefrom. Scales 52 and 54 are detachably fixed to the scale mounting plate 42 as shown in FIG. 3. Numeral 56 denotes a bottom portion cover fixed to the base plate 40, and 58 denotes an upper portion cover mounted on the cover 56. The support base plate 18, stationary disc 32, protractor 34, index ring 36 and tube 20 constitute a non-rotating portion of the head. Numeral 60 denotes a tubular member fixed to the mounting plate 24, and teeth 60*a* are provided on a lower portion of the tubular member 60. The center of rotation of the teeth 60*a* and the center of rotation of the spindle tube 22 are coaxial. Numeral 62 denotes a gear journaled at 64 rotatably on the support base plate 18, and the gear 62 is meshed with the teeth 60*a*. In FIG. 1, numeral 66 denotes a guide groove extending lengthwise in a radial direction of the gear 62, and an element 68 is disposed for slidable movement in the longitudinal direction of the guide groove 66. Numeral denotes a threaded shaft rotatably journaled on the gear 62, and a threaded hole in the element 68 is threaded on the shaft 70. One end of the shaft 70 has a knob 72 thereon. Numeral 74 denotes a cylinder having one end open and fixed to the support base plate 18, and a disc member 76 is slidable in the cylinder 74, and one end of a coil spring 78 is in resilient contact with the disc member 76. Numeral 80 denotes a rope guide in the form of a rope pulley journalled rotatably on the support base plate 18, and a bendable wire rope 82 having a flexibility is spanned on the rope guide 80. One end of the rope 82 is connected to the disc member 76. A metal terminal 84 is fixed to the other end of the rope 82, and the terminal 84 is connected rotatably to a projection on the element 68. When the terminal 84 is positioned closer to the rope guide 80, the initial zero position of the spring 78 is set so that the tensile force on the rope 82 due to the spring 78 is zero, namely, the amount of flexing of the spring 78 becomes zero, and a spring 78 is employed which has a spring constant corresponding to the weight of the base plate 40, scale mounting plate 42 and scales 52 and 54. The head 16 is so constructed that it will be static at an optional position on the inclined drawing board 2 by a known head balancing device (not shown).

The operation of this embodiment will be described in the following.

Figure 8:
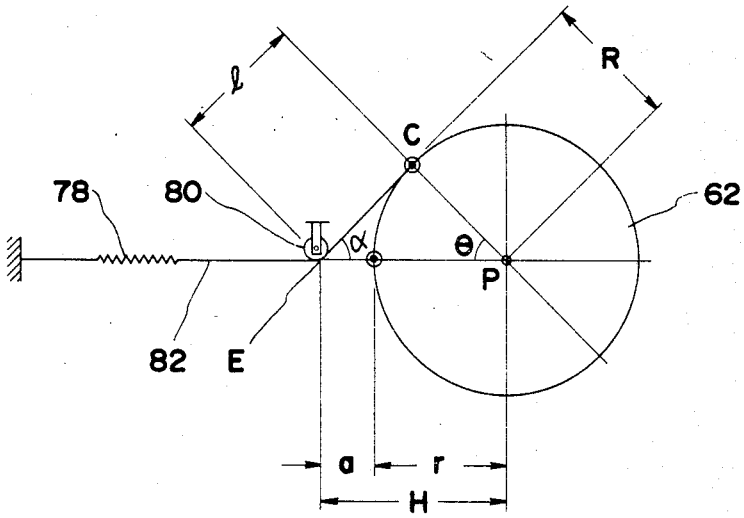
FIG. 8 is an explanatory drawing of forces on the rotating member.

In the first place, the drawing board 2 is set at a desired inclined angle relative to the floor level. When pressure is applied to the handle 26 in an optional direction in parallel to the surface of the drawing board 2 by gripping the handle 26 of the head 16, the head 16 can be parallelly shifted to a desired location on the drawing board 2. In a condition where the head 16 is static at an optional position on the drawing board 2, when the index lever 28 is manually shifted in a left direction, the conical bar 30 is swung in a counterclockwise rotating direction in FIG. 2 with its bulged portion 30*a* as a fulcrum, and the transmitting member 48 is shifted in the right direction. With this shifting, the swing arm 44 is swung in a clockwise rotating direction in FIG. 3 with the shaft 46 as a center, and its pawl portion 44*a* is separated from the recess of the index ring, and the scale mounting plate 42 becomes freely rotatable around the inner diameter portion of the tube 20 as a center. Namely, the fixing of the scale mounting plate 42 relative to the non-rotating member is released. In this condition, a rotatory torque is generated on the spindle tube 22 by the weight of the base plate 40, scale mounting plate 42, and scales 2 and 54, and this rotatory torque is transmitted to the gear 62 by means of the rotating member 60 and the teeth 60*a*. With this transmission, a rotatory torque T′ centering around the shaft 64 is generated on the gear 72, namely, the rotating member interlocked with the scale mounting plate 2. The magnitudes of the rotatory torque T′ and of the rotatory torque 90 working on the rotating member due to the elastic force of the spring 78 are identical, and the torques are in opposite directions. Accordingly, the scales 52 and 54 are static on the drawing board 2 even if they are in a free rotating condition and never rapidly rotate due to their own weight. The foregoing operation will be described more in detail by referring to the explanatory drawing of FIG. 8.

In a condition where the rotating member such as gear 62 that rotates by interlocking with the scale mounting plate rotates around a point P, and the rope 82 connected to point C of the rotating member 62 is tensioned, the spring 78 by the angle $\theta$ where the distance between point C and the control point E of the contact of the rope with the guide 80 is the shortest distance is set at zero degree, and the rotating member 62 is rotated through an angle $\theta$, the rotatory torque T generated on the rotating member 62 by the spring 78 will be considered. In the first place, the strength F of the spring when the rotating member 62 is rotated through the angle $\theta$ is $F=kx=k\ (1-a)$ provided that k denotes the spring constant of the spring 78, and x denotes the quantity of expansion of the spring 78, and at the angle $\theta$ of the rotating member 62 of zero degree the tension of the spring 78 is zero.

The foregoing l can be obtained by the following formula.

$$
\begin{aligned}
l &= \{(r \cdot \sin\theta)^2 + (r + a - r \cdot \cos\theta^2)\}^{\frac{1}{2}} \\
&= [r^2 \cdot \sin^2\theta + \{r(1 - \cos\theta) + a\}^2]^{\frac{1}{2}} \\
&= \{r^2 \cdot \sin^2\theta + r^2(1 - 2\cos\theta + \cos^2\theta) + 2ra(1 - \cos\theta) + a^2\}^{\frac{1}{2}}
\end{aligned}
$$

-continued $$= \{(r^2 \cdot \sin^2\theta + r^2 - 2r^2\cos\theta + r^2 \cdot \cos^2\theta + 2 \cdot r \cdot a - 2 \cdot r \cdot a \cdot \cos\theta + a^2\}^{\frac{1}{2}}$$
$$= \{r^2(\sin^2\theta + \cos^2\theta) + r^2 - 2r^2 \cdot \cos\theta + 2 \cdot r \cdot a(1 - \cos\theta) + a^2\}^{\frac{1}{2}}$$
$$= \{2r^2 - 2r^2 \cdot \cos\theta + 2 \cdot r \cdot a(1 - \cos\theta) + a^2\}^{\frac{1}{2}}$$
$$= \{2r^2(1 - \cos\theta) + 2r \cdot a(1 - \cos\theta + a^2\}^{\frac{1}{2}}$$
$$= \{(1 - \cos\theta)(2r^2 + 2r \cdot a) + a^2\}^{\frac{1}{2}}$$

Also, the radius R of rotation required for the rotation of the rotating member by the tension of the rope 82 can be obtained as $R=(a+r).\sin\alpha$. When this R is deformed, $$R=(a+r).r.\sin\theta/l$$

The torque T for rotating the rotating member 62 due to the elongation of the spring 78 is $T=F\times R$ so that when values of the F and the R are applied to this formula, the result is as follows.

$$T=k\,(l-a).(a+r)\,r.\sin\theta/l$$

Figure 9:
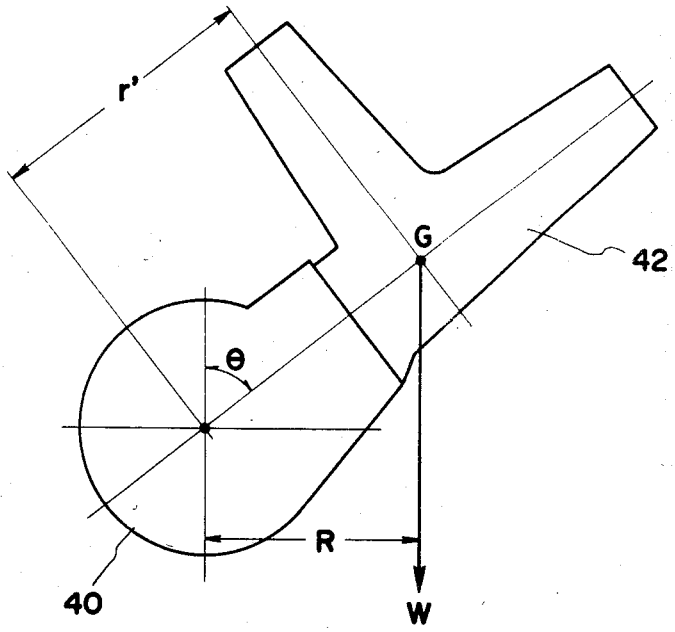
FIG. 9 is an explanatory drawing of the forces on the head.

In case $a=0$, $T=k.r^2.\sin\theta$. kr is constant, and from this formula, T is found to be a function of $\sin\theta$. Now, as shown in FIG. 9, w is applied on the center of gravity G on the base plate 40 in the direction for rotating the base plate 40. Assuming that the load w due the weight of the scale is a distance r' between the center of gravity G and the center of rotation of the base plate 40, the base plate 40 is rotated until the scale 62 (refer to FIG. 3) becomes almost parallel to the vertical rail 8, and the load w does not work as the rotatory torque on the base plate 40 and the condition of the base plate 40 is zero degrees, the rotatory torque T' generated by the load when the base plate 40 is rotated by $\theta$ degrees is obtained from $T'=w.r'.\sin\theta$. The value of wr' is constant, and thus, the torque T' is found to be a function of $\sin\theta$.

Figure 10:
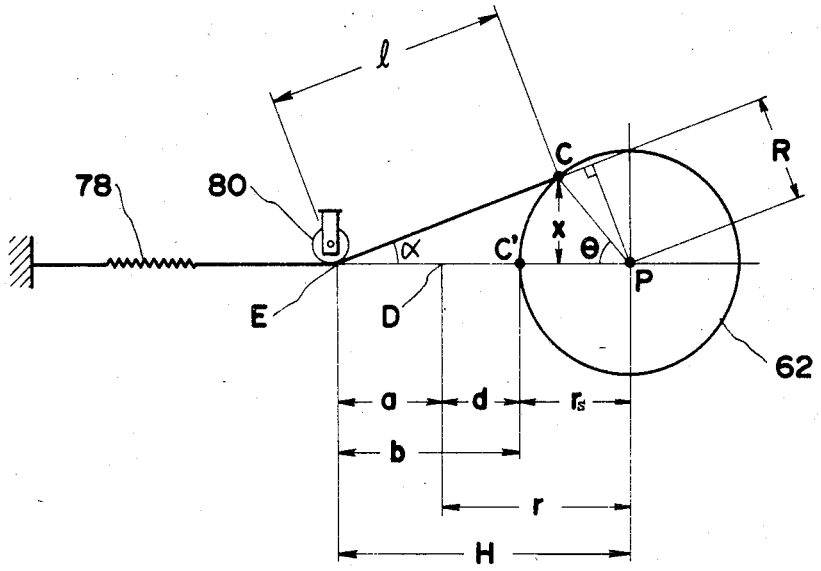
FIG. 10 is an explanatory drawing similar to FIG. 8.

This shows that in case $a=0$, the rotat torques T and T' in both directions, clockwise and counterclockwise rotating directions of the rotating member, can be completely balanced. Also, as shown in FIG. 10, the change of torque when the foregoing r is shortened becomes $$l=\{(1-\cos\theta)(2.rs^2+2rs.b)+b^2\}^{\frac{1}{2}}$$

by changing $$l=\{(1-\cos\theta)\,(2r^2+2r.a)+a^2\}^{\frac{1}{2}}.$$

By the way, rs denotes the distance of the center of rotation of the rotating member 62 and the rope connection point C, and b denotes the distance of the rope control point of the guide 80 and the rope connection point C' when the rotating member 62 is at zero degrees. When the rope correction point C is shifted to point D, the tension of the rope 82 becomes zero. When a denotes the distance of this point D and the rope control point E of the guide 80 and d denotes the distance at the point D and the rope connection point C', the above b is represented by the following formula.

$$b=(a+d)$$

The elongation lr of the actual spring 78 is as follows.
$lr=(l-b)+d$

The strength F of the spring 78 is $F=K(l-b+d)$. Also, the radius R of rotation to be imagined on the rotating member 62 as a rotatory torque generaing element is $$R = (a + r)\sin\alpha = (a + r)\,rs \cdot \sin\theta/l$$

Accordingly, the rotatory torque T generated on the rotating member 62 by the spring 78 is $$T = F \times R = k\,(l - b + d)\,(a + r)\,rs \cdot \sin\theta/l$$

Since the value of l is changed by the rotation angle of the rotating member 62, the change characteristic of the rotatory torque T generated on the rotating member 62 by the spring 78 does not form a curve of $\sin\theta$. However, as the change characteristic accompanied by the rotation of the scale of the rotatory torque T' generated on the rotating member b2 by the weight of the scale forms a curve of $\sin\theta$, the rotatory torque in the clockwise and counterclockwise rotating directions generated on the rotating member 62 cannnot be balanced. But, in FIG. 10, when the point of connection of the rope on the rotating member 62 is brought to control position E of the rope of the rope guide 80, and the setting is made so that the tension of the spring 78 becomes zero, the spring force F of the spring 78 can be found as follows.

$$F=kl$$

Now, assuming that H denotes the distance between the rope guide point E and the center P of rotation of the rotating member 62, and rs denotes the distance between the rope connection points C and P, the elongation l of the spring 78 becomes $$l = \sqrt{H + rs - 2H.rs.\cos\theta}$$

The radius R of rotation to be imagined on the rotating member 62 as the rotatory torque generating element by the spring 78 is $R=H.\sin\alpha$.

As $x=l.\sin\alpha=rs.\sin\theta$, $R=H.rs.\sin\theta/l$ Accordingly, the rotatory torque generated on the rotating member 62 by the spring force of the spring 78 becomes as follows.

$$T = kl \times R = kl \times \frac{H \cdot rs \cdot \sin\theta}{l} = k \cdot H \cdot rs \cdot \sin\theta$$

Figure 11:
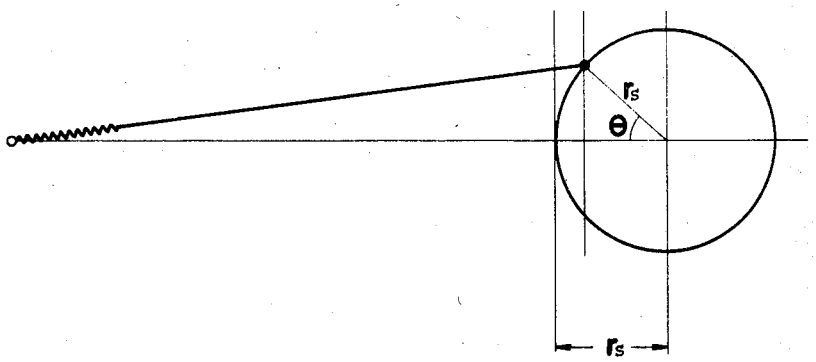
FIG. 11 is an explanatory drawing similar to FIG. 8.

Accordingly, the rotatory torque T produced by the spring 78 becomes $\sin\theta\times$constant, and sine curve. From the foregoing formula, when the spring connection point C is shifted to the rope control point E of the rope guide 80, the setting is made so that the tension of the spring 78 becomes zero, even if the spring connection point C is set at an optional position on the rotating member 62, the change characteristic of the rotatory torque T generated on the rotating member $\beta$ is found to become a sine curve. When the connection point C is set in the center of rotation of the rotating member 62, and $b=0$ is set, $T=0$ is obtained. By the way, as shown in FIG. 11, if the rope guide is not provided, or assuming that the rope guide is located at an infinitely remote location relative to the rotating member, the spring force of the spring becomes $$\text{spring force} = k\,(rs - rs \cdot \cos\theta) = k \cdot rs\,(1 - \cos\theta)$$

Also, the radius R of rotation to be imagined on the rotating member as the rotatory torque generating element by the spring is R=rs.sin $\theta$ so that the rotatory torque T generated on the rotating member by the tensile force of the spring becomes as follows.

$$T = krs\,(1 - \cos\theta) \times rs \cdot \sin\theta = k \cdot rs^2 \cdot \sin\theta\,(1 - \cos\theta)$$

Figure 12:
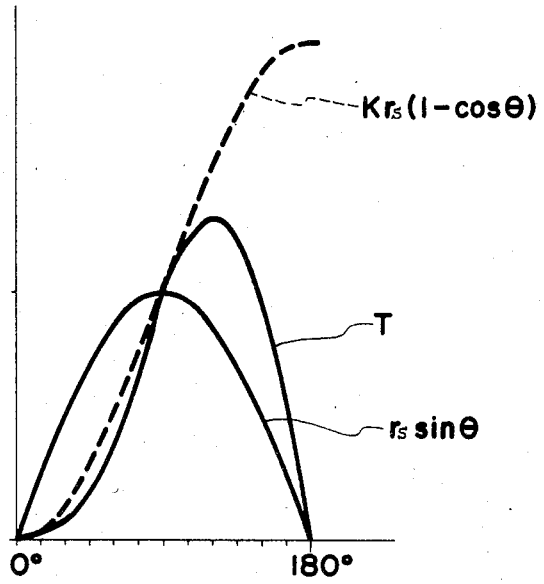
FIG. 12 is a diagram of the torque on various parts of the apparatus

Accordingly, the change characteristic of the rotatory torque T does not form the curve of sine as shown in FIG. 12.

Figure 14:
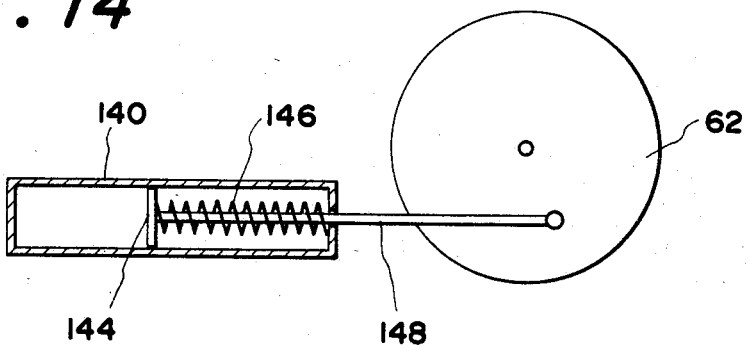
FIG. 14 is an explanatory drawing relating to the embodiment of FIG. 13.
Figure 18:
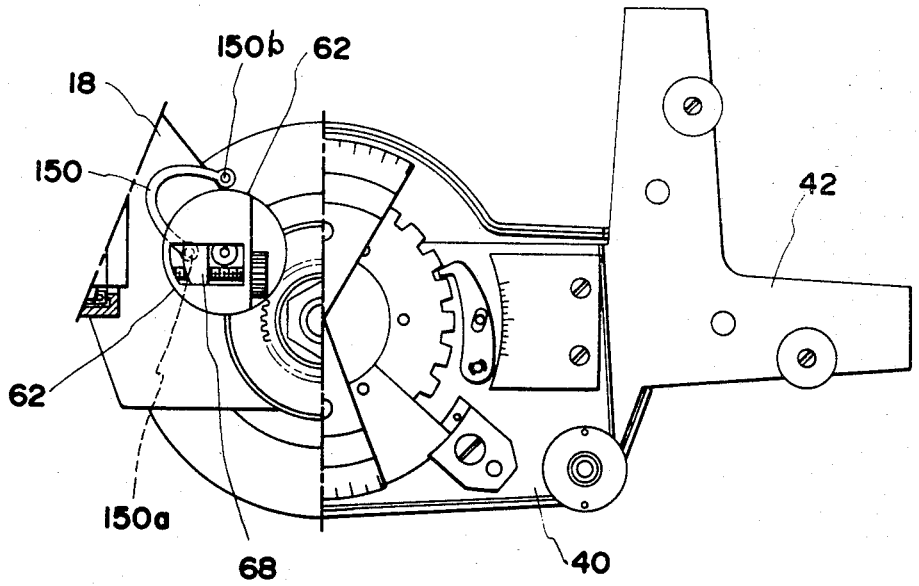
FIG. 18 is a plan of a head, partly cut away, illustrating still another embodiment.
Figure 20:
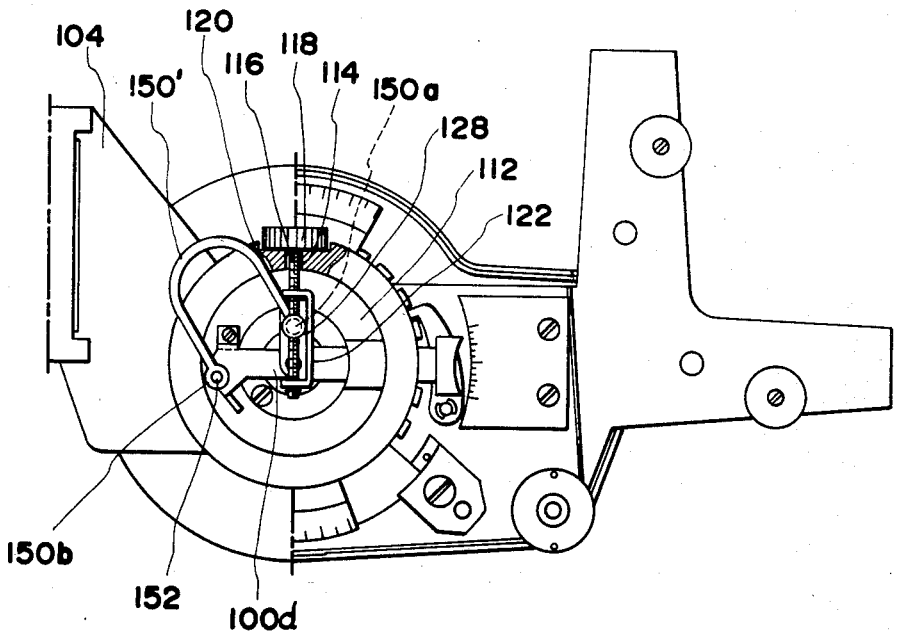
FIG. 20 is a plan of the head of FIG. 19.
Figure 21:
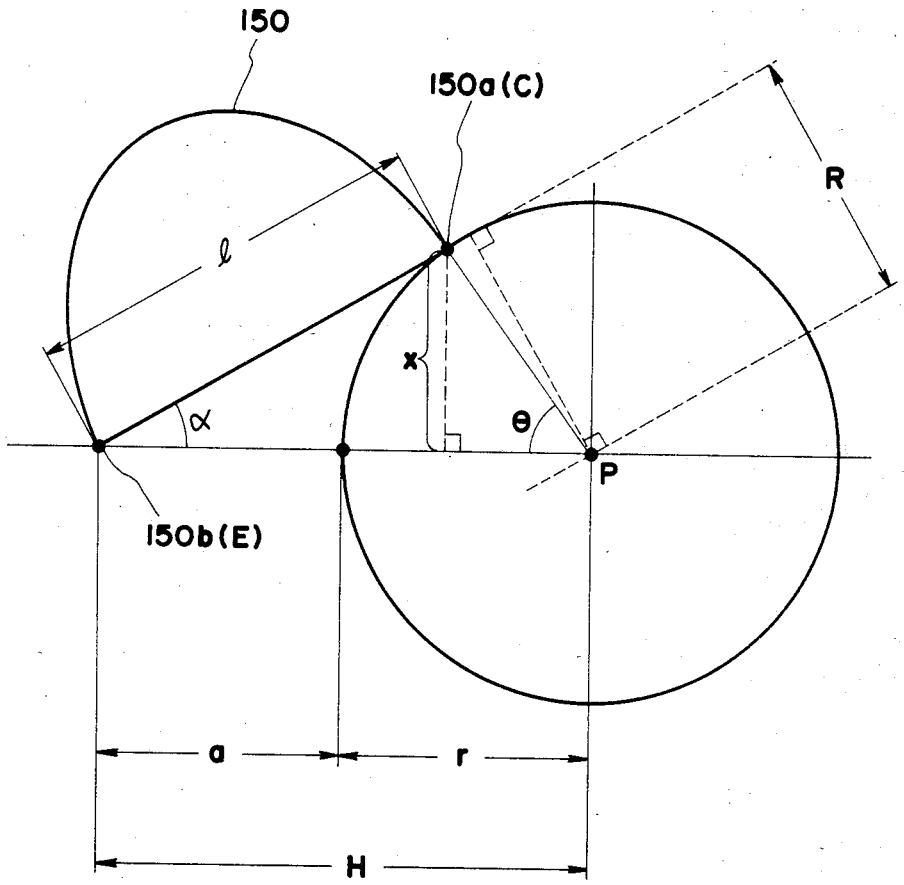
FIG. 21 is an explanatory drawing of the forces on the rotating member of FIG. 20.

In the foregoing embodiment, assuming that the entire construction consisting of the coil spring 78 and the wire rope 82 is one spring means, one end of the spring means is rotatably supported on the non-rotating member 18 by the trope guide 80. The other end of the spring means is rotatably connected to the eccentric portion of the rotating member 62. In this construction, when the portion of the spring means connected with the rotating member 62 is shifted to the rotation support portion on the non-rotating member 18 of the spring means, namely, the control point E of the rope, if the initial zero condition of the spring means is set so that the elastic force of the spring means becomes just zero, it shows that the scale keeps a complete balance. This theory is not assumed only in the construction using the coil spring 78 and the wire rope as the spring means as described in the foregoing, and as shown in the embodiment to be described hereinafter, but it can be applied to the construction of the spring means consisting of the cylinder and the coil spring and the rope as shown in FIG. 14 or to the case of using a single bending spring as shown in FIG. 18 and FIG. 20.

The operation of adjusting the radius R of rotation will be described in the following.

When the knob 72 is rotated, the threaded shaft 70 is rotated. By the rotation, the element 68 is shifted along the guide groove 66, and the rope terminal 84 is shifted in the radial direction on the rotating member 62 by being interlocked with the element 68. The distance of the rope connection point C from the center of rotation of the rotating member 62 is changed by the shifting of the rope terminal 84. The value of the load W applied on the base plate 40 by the weight of the scale is changed by changing the inclination angle of the drawing board. Accordingly, when the inclination angle of the drawing board 2 is changed, the magnitude of the rotatory torque T generated on the rotating member 62 by the tensile load F of the spring 78 can be made to coincide with the rotatory torque T' generated on the rotating member by the load W by the rotation of the knob 72.

Figure 6:
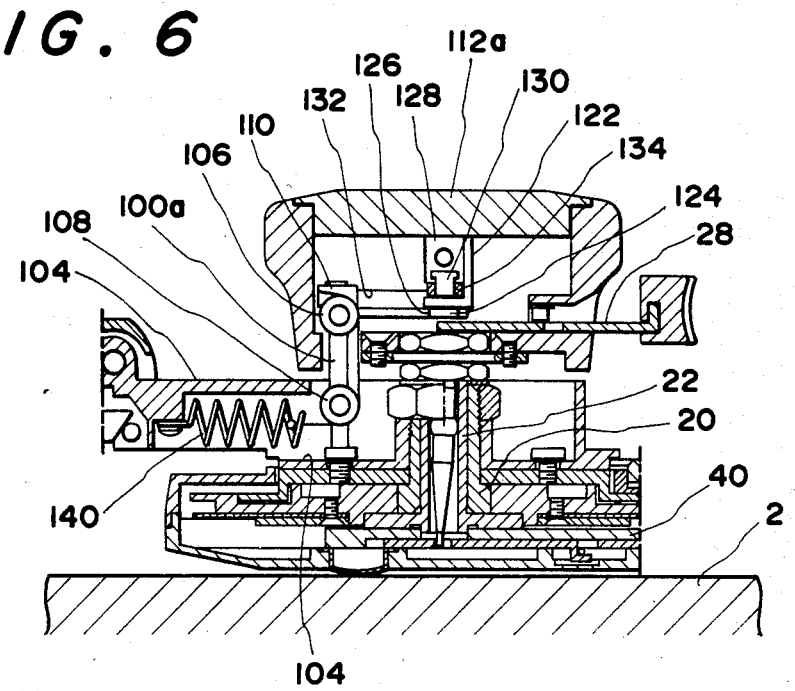
FIG. 6 is a cross section of a head illustrating another embodiment.
Figure 7:
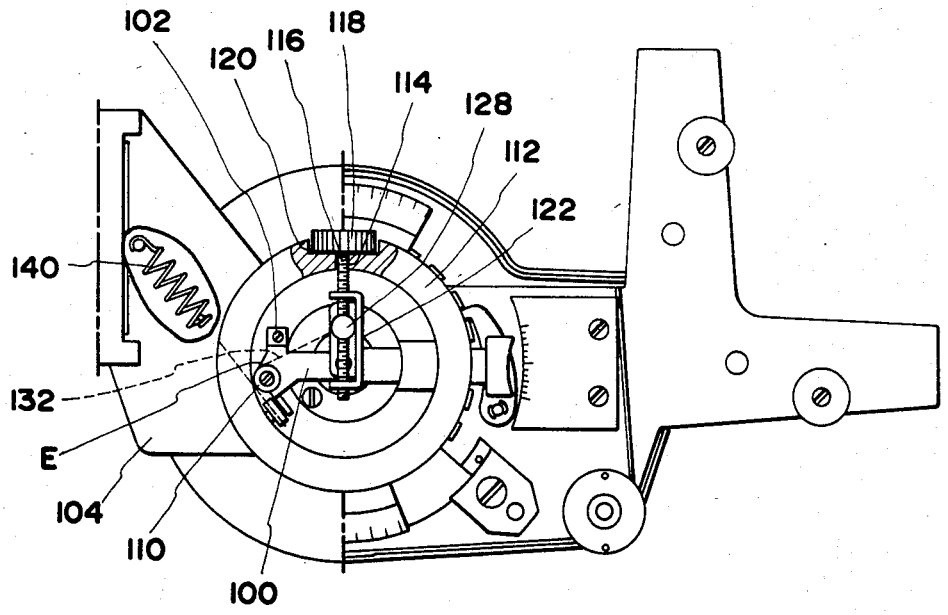
FIG. 7 is a plan of the head of FIG. 6 and partly cut away.

Another embodiment of this invention will be described in the following by referring to FIG. 6 and FIG. 7.

Numeral 100 denotes a bracket, and the lower end of a perpendicular portion 100*a* of the bracket is fixed to a support base plate 104 by a screw 102. At upper and lower ends of the perpendicular portion 100*a* of the bracket 100, vertical rope pulleys 106 and 108 are rotatably supported. The upper end of the perpendicular portion 100*a* is adjacent to the rope pulley 106, and a rope guide 110 constituted by a horizontal rope pulley is rotatably supported thereon. Numeral 116 denotes a threaded shaft rotatably inserted into a horizontal hole 114 bored in a side wall of a handle 112 (rotating member), and a knob 118 is fixed to one end of the shaft 116. One surface of the knob 118 abuts rotatably in a recess 120 formed in the handle 112. Numeral 122 denotes a frame, and the shaft 116 is rotatably inserted into holes bored in a pair of side walls of the frame, and a disc like projection 124 projecting from the bottom wall of the frame 122 is fitted rotatably into a hole 126 bored on a horizontal portion of the bracket 100. The center of the hole 126 is coaxial with the center of rotation of the handle 112. The upper end of the frame 122 abuts the lower surface of a cap 112*a* of the handle 112. Numeral 128 denotes an element threaded onto shaft 116, and a shaft 130 is fixed to a lower end of the element, and a terminal 134 of a flexible wire rope 132 is fitted on the shaft 130. The shaft 116 is so constructed that it does not shift in the axial direction thereof relative to the frame 122. The lower end of the shaft 130 abuts slidably on the upper surface of a horizontal portion of the frame 122. One side surface and the upper surface of the element 128 abut slidably on the side surface of the perpendicular portion of the frame 122 and the lower surface of the cap 12*a* of the handle 112. Numeral 140 denotes a coil spring whose one end is secured to the support base plate 104 by a screw and one end of the wire rope is connected to the other end portion of the coil spring 140. The wire rope 132 is reeved around the pulleys 108 and 106, and the rope guide 110, and the other end is connected to the terminal 134. The internal construction of the head is identical with an construction of the head shown in FIG. 2 so that the description thereof is omitted. In the foregoing construction, the spring 140 and the wire rope 132 constitute one spring means as a whole, and the rope control point E is at the rope guide 110 which rotatably supports the spring means. In this construction, when the center point of the hole of the terminal 134 is shifted toward the rope control point E of the rope guide, the setting is so made that the tension of the spring 140 becomes just zero. This means, in other word, that when the connection point of the spring means with the rotating member 112 is shifted close to the rotation support portion of the non-rotating member of the spring means, the initial zero condition of the spring means is so set that the elastic force of the spring becomes just zero. Also, when the handle 112 of the head is rotated in a counterclockwise rotating direction in FIG. 7 on the inclined drawing table until the scale 52 becomes almost parallel to the vertical rail 8 (refer to FIG. 3), and the rotatory torque T' generated on the handle 112 by the weight of the scales 52 and 54 is zero, the terminal 134 approaches the closest to the rope guide 106, and the radius R of rotation of the handle 112 as the rotatory torque generating element acted on by the spring 140 becomes zero. The rotatory torque T' generated on the spindle tube 22 in a clockwise rotating direction in FIG. 9 by the weight of the scale and the scale mounting plate is transmitted to the handle 112 (rotating member). On the other hand, the tensile force of the spring 140 is transmitted to the handle 112 by means of the rope 132 and the element 128, and the rotatory torque T is generated on the handle 112 in an anticlockwise rotating direction in FIG. 7 by the tensile force of the spring 140. In a condition where the drawing board is fixed at a predetermined inclination angle, the magnitudes of the rotatary torques T and T' are set identically, and when the scale is released to a free condition, the scale is static on the inclined drawing board, and remains in complete balance. When the inclination angle of the drawing board is changed, the magnitude of the rotatory torque T' is changed. In this case the knob 118 is rotated and the element 128 is shifted in the radial direction of the handle 112 along the short 116, and the magnitude of the rotatory torque T' is made to coincide with the magnitude of the rotatory torque T.

Figure 13:
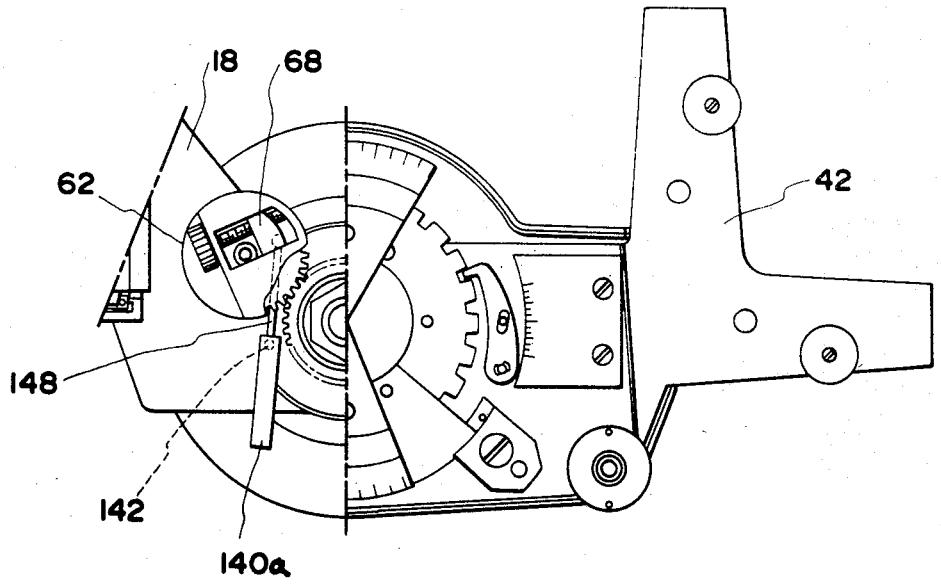
FIG. 13 is plan view of a head partly cut away, and illustraing another embodiment.
Figure 15:
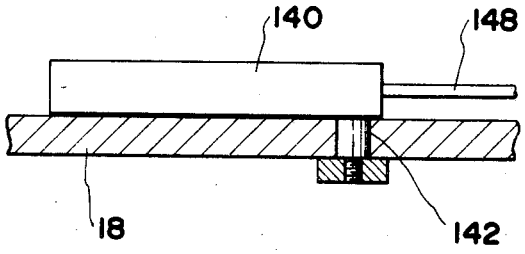
FIG. 15 is an elevation view of a part of the embodiment of FIG. 13.

A further embodiment of this invention, which is a modification of that of FIGS. 1–5 will be described in the following by referring to FIG. 13 through FIG. 15.

Numeral 140*a* denotes a cylinder like spring holder whose one open end is rotatably journaled at 142 for rotation in a plane in parallel to the rotating plane of the rotating member 62 on the support base plate 18, and a disc member 144 is slidably disposed in the cylinder. Numeral 146 denotes a coil spring compressed and disposed in the spring holder 140*a*, and its one end is elastically in contact with the disc member 144. Numeral 148 denotes a rod, and its rear end is fixed to the disc member 144, and the tip of the rod 148 is rotatably connected to a projection on the element 68. The rod 148, spring holder 140 and coil spring 146 constitute one spring means. When the connection point of the spring means with the rotating member 62, namely, the tip of the rod 148 is positioned closest to the rotation support portion of the spring means, namely, the axis 142, the setting of an initial zero position of the spring means is made so that the elastic foce of the coil spring 146, namely, the elastic force of the spring means becomes just zero. A coil spring 146 is employed which has a spring constant corresponding to the weight of the base plate 40, scale mounting plate 42 and scales 52 and 54.

In the foregoing construction, when the fixing of the scale mounting plate 42 relative to the non-rotating member is released, the rotatory torque T' is generated on the rotating member 62 by the weight of the scales 52 and 54 which centers around the shaft 64. The magnitudes of the rotatory torque T' and that of the rotatory torque T acting on the rotating member 62 due to the elastic force of the spring 146 are identical, and the torques are in opposite directions. Accordingly, the scales 52 and 54 remain in complete balance, and even if the scales 52 and 54 are in a free rotating condition on the inclined drawing board, the scales are static on the drawing board, and do not rapidly rotate due to their own weight. The theory of the complete balance of the scales in this embodiment is identical with the theory described in the first embodiment.

Figure 16:
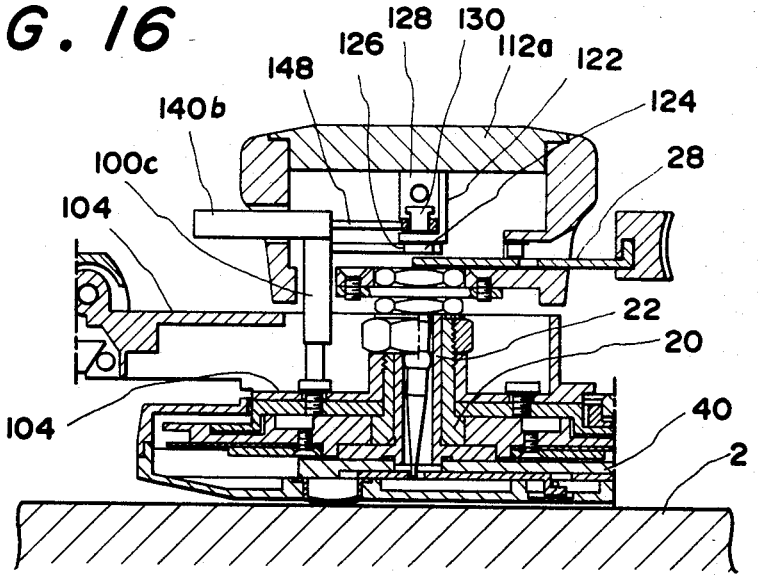
FIG. 16 is a cross section of the head of another embodiment.
Figure 17:
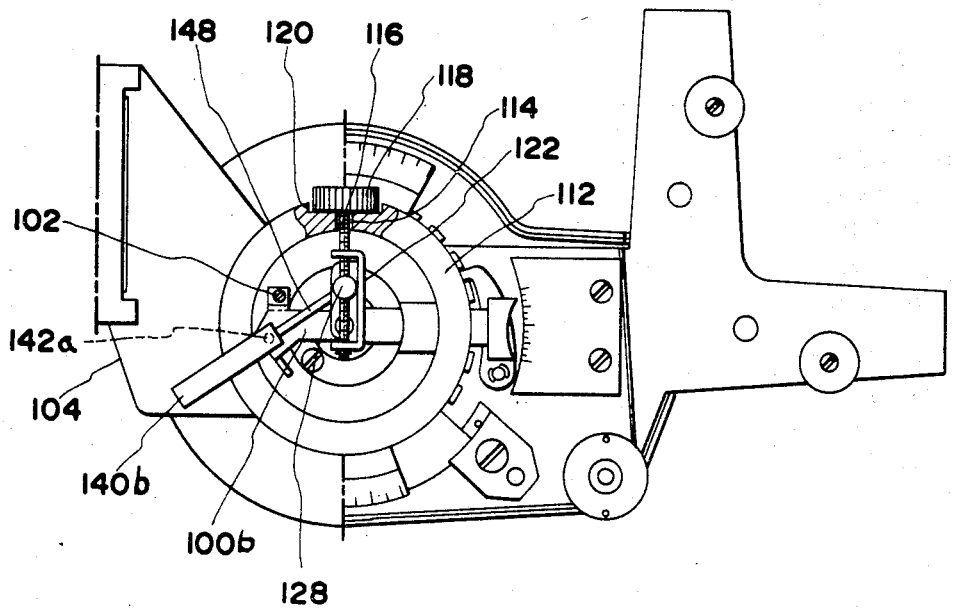
FIG. 17 is a plan of the head, partly cut away, of the embodiment of FIG. 16.

A still further embodiment of this invention, which is a modification of that of FIGS. 6 and 7, will be described in the following by referring to FIG. 16 and FIG. 17.

Numeral 100*b* denotes a bracket and the lower end of a perpendicular portion 100*c* of the bracket 100*b* is fixed to a support base plate 104 by means of a screw 102. A horizontal portion of the bracket 100*b* is rotatably journaled on shaft 142*a* to an end of a cylinder 140*b* containing a spring like the spring 146 of FIG. 14. The shaft 142*a* constitutes a rotation support portion of the spring means. In a side wall of the handle 12, a notched portion for cylinder 140*b* is formed. Numeral 116 denotes a threaded shaft rotatably inserted into a horizontal hole 114 bored in a side wall of the handle 112 (rotating member), and a knob 118 is fixed to one end of the shaft 116. One surface of the knob 118 abuts rotatably in a recess 120 formed in the handle 112. Numeral 122 denotes a frame, and the shaft 116 is rotatably inserted into a hole bored a pair of side walls of the frame 122, and a disc like projection 124 projecting from a bottom wall of the frame 122 is rotatably fitted in a hole 126 bored in the horizontal portion of the bracekt 100*b*. The center of the hole 126 is coaxial with the center of rotation of the handle 112. The upper end of the frame 122 abuts the lower surface of a cap 112*a* of the handle 112. Numeral 128 denotes an element threaded onto the shaft 116, and a shaft 130 is fixed to the lower end, and the hole in the tip of a rod 148 is rotatably fitted on the shaft 130. The shaft 116 is so constructed that it does not shift in the axial direction relative to the frame 122. The lower end of the shaft 130 abuts slidably on the upper surface of a horizontal portion of the rame 134, and one side surface of the element 128 and the upper surface abut slidably the side surface of the perpendicular portion of the frame 122 and the lower surface of the cap 112*a* of the handle 112. The internal construction of the head is identical with the construction of the head shown in FIG. 6 so that the description thereof is omitted. In the foregoing construction, when the center point of the hole of the tip of the rod 148 is shifted closest to the center of rotation of the cylinder 140*b*, the setting is so made that the elastic force of the spring becomes zero. Also, when the handle 112 of the head is rotated on the inclined drawing board in a counterclockwise rotating direction in FIG. 17 until the scale 52 becomes almost parallel to the vertical rail 8 (refer to FIG. 1), and the rotatory torque T' generate on the handle 112 by the weight of the scales 52 and 54 is zero, the tip of the rod 148 approaches closest to the center of rotation of the cylinder 140*b*, and the radius R of rotation of a rotatory torque generating element of the handle 112 becomes zero. The rotatory torque T' generated on the spindle tube 22 in the clockwise rotating direction in FIG. 17 by the weight of the scales and scale mounting plate is transmitted to the handle 112 (rotating member). On the other hand, the tensile force of the spring is transmitted to the handle 112 by means of the rod 148 and the element 128, and a rotatory torque T is generated on the handle 112 in the counterclockwise rotating direction in FIG. 17 by the tensile force of the spring. In a condition where the drawing board is fixed at a predetermined inclination angle, the magnitudes of the rotatory torques T and T' are set identically, and when the scale is in free condition, the scale is static on the inclination drawing board, and remains in complete balance. When an inclinatory angle of the drawing board is changed, the magnitude of the rotatory torque T' is changed. In this case, the knob 118 is rotated, and the element 128 is shifted in a radial direction of the handle 112 along the shaft 116, and the magnitude of the rotatory torque T' is made to coincide with the magnitude of the rotatory torque T.

Still another embodiment of this invention, which is a modification of that of FIGS. 1—5, will be described in the following by referring to FIG. 18.

Numeral 150 denotes a bendable spring whose one end 150*b* is rotatably journaled at 152 on the support base plate 18 in a plane in parallel to the rotation plate of the rotating member 62, and the other end 150*a* of the bendable spring 150 is rotatably connected to the projection on the element 68. When the other end 150*a* of the bendable spring 150, is positioned at a position corresponding to that where the mounting plate and scales exert a zero torque on rotating member 62 of the spring means is set so that the elastic force of the spring means becomes just zero. A spring 150 is employed which has a spring constant corresponding to the weight of the base plate 40, scale mounting plate 42 and scales 52 and 54. The rotating member 62 is provided with a notched portion for spring 150, and the spring 150 is constructed to be able to shift in the notched portion according to the shifting of the other end portion 150*a* in a predetermined rotating range of the rotating member 62. The internal construction of the head is identical with the internal construction of the head shown in FIG. 2.

In the foregoing construction, when the fixing of the scale mounting plate 42 relative to the non-rotating member is released, a rotatory torque T′ is generated on the rotating member 62 by the weight of the scales 52 and 54 whih centers around the shaft 64. The magnitudes of this rotatory torque T′ and a rotatory torque T acting on the rotating member 62 are identical, and the torques are in opposite directions. Accordingly, the scales 52 and 54 remain in complete balance and even if the scales 52 and 54 are in a free rotating condition, the scales are static on the drawing board 2 and do not rapidly rotate due to their own weight. The theory of the complete balance of the scales in this embodiment is wholly identical with the theory described in the first embodiment.

Figure 19:
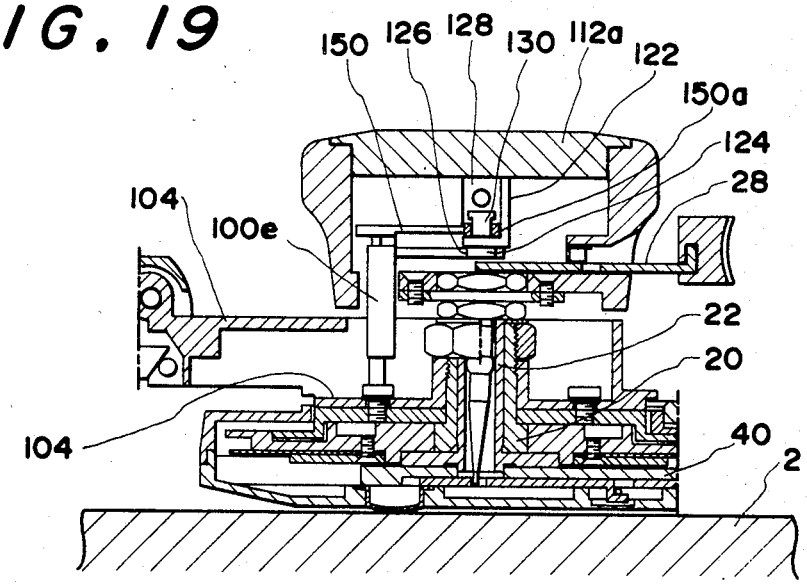
FIG. 19 is a cross section of the head of still another embodiment.

A still further embodiment of this invention, which is a modification of that of FIGS. 6 and 7, will be described in the following by referring to FIG. 19 and FIG. 20.

Numeral 100*d* denotes a bracket, and the lower end of a perpendicular portion 100*e* of the bracket is fixed to a support base plate 104 by a screw 102. One end 150*b*′ of a spring 150′ is rotatably journaled at 152 to a horizontal portion of the bracket 100. A notched portion for spring 150 is formed in a side wall of the handle 112. Numeral 116 denotes a threaded shaft rotatably inserted to a horizontal hole 114 bored in a side wall of the handle 112 (rotating member), and a knob 118 is fixed to one end of the shaft 116. One surface of the knob 118 abuts rotatably in a recess 120 formed in the handle 112. Numeral 122 denotes a frame, and the shaft 116 is rotatably inserted in a hole bored in a pair of side walls of the frame 122, and a disc like projection on a bottom wall of the frame 122 is rotatably fitted in a hole bored in a horizontal portion of the bracket 100*d*. The center of the hole 126 is coaxial with the center or rotation of the handle 112. The upper end of the frame 122 abuts the lower surface of a cap 112*a* of the handle 112. Numeral 128 denotes an element threaded onto the shaft 116, and a shaft 130 is fixed to the lower end of the element, and the hole in the other end 150*a*′ of a spring 150′ is rotatably fitted on the shaft 130. The shaft 116 is constructed so that it is not shifted in the axial direction of the shaft 116 relative to the frame 122. The lower end of the shaft 130 abuts slidably on the upper surface of a horizontal portion of the frame 134, and one side surface and the upper surface of the element 128 abut slidably a side surface of a perpendicular portion of the frame 122 and a lower surface of the cap 122*a*. The internal construction of the head is identical with the internal construction of the head shown in FIG. 6 so that the description thereof is omitted. In the foregoing construction, when the center point of a hole of the other end 150*a*′ of the spring 150′ is shifted closest to the center (rotation support point) of a hole in the one end 150*b*′ of the spring 150′, the setting of an initial zero position of the spring 150 is made so that the elastic force of the spring 150 becomes zero. Also, when the handle 112 of the head is rotated in a counterclockwise direction in FIG. 20 on the inclined drawing board and the scale 52 becomes almost parallel to the vertical rail (refer to FIG. 3), and the rotatory torque T′ generated on the handle 112 by the weight of the scales 52 and 54 becomes zero, the other end 150*a*′ of the spring 150′ approaches the most closely to the one end 150*b* of the spring, and the radius R of rotation of a rotatory torque generating element of the handle 112 becomes zero. The rotatory torque T′ generated on the spindle tube 22 in clockwise rotating direction in FIG. 20 by the weight of the scales and scale mounting plate is transmitted to the handle 112 (rotating member). On the other hand, the elastic force of the spring 140′ is transmitted to the handle 112 by means of the element 128, and a rotatory torque T is generated on the handle 112 in the counterclockwise rotating direction in FIG. 20 by the elastic force of the spring 150′. In a condition where the drawing board is fixed at a predetermined inclination angle, the magnitudes of the rotatory torques T and T′ are set identically, and when the scales are in free condition, the scales are static on the inclinatory drawing board, and remain in complete balance. The theory of this complete balance is identical with the theory described in the first embodiment.

What is claimed is:

1. A scale balancing device for balancing the weight of the scales of a universal parallel ruler, said device comprising a head structure having the scales rotatably mounted thereon, a rotating member rotatably mounted on said head structure separate from said scales, means rotatably interlocking said rotating member and said rotatable scales, and a spring means having one end rotatably connected to a point on said rotating member eccentric to the axis of rotation thereof and the other end rotatably connected to a non-rotatable part of said head structure, said spring means, when said scales are rotated to a position in which the weight thereof is vertically in line with the axis of rotation thereof, having substantially no tension therein and when the scales are rotated ninety degrees from said position, having tension for exerting a maximum force on said eccentric connection point on said rotating member and sufficient in magnitude and having a direction which substantially cancels out the torque on said rotating member from the weight of the scales.

2. A scale balancing device as claimed in claim 1 in which said head structure has a rotatable member on which said scales are mounted, and said rotatable member and said rotating member are directly rotatably interlocked by said interlocking means.

3. A scale balancing device as claimed in claim 1 in which said spring means comprises a spring having the other end secured to a non-rotatable portion of said structure and having a flexible rope connected between said one end and said eccentric connecting point, and a rope guide means on the non-rotatable part of said head structure for guiding said rope in the desired direction toward said connection point.

4. A scale balancing device as claimed in claim 1 in which said spring means comrpises a spring holder rotatably mounted on the non-rotatable part of said head structure, a spring mounted in said holder and a rod connected to said spring and having the other end connected to said connection point and said rod movable into and out of said holder for compressing said spring to increase the force on said connection point to provide the desired torque on said rotating member.

5. A scale balancing device as claimed in claim 1 in which said spring means is a bendable spring having one end connected to said rotatable member and the other end connected to a non-rotatable part of said head structure.

* * * * *